US010016889B2

(12) United States Patent
Kao

(10) Patent No.: US 10,016,889 B2
(45) **Date of Patent: *Jul. 10, 2018**

(54) SLEEVE BRACKET ASSEMBLY

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 361 days.

This patent is subject to a terminal disclaimer.

(21) Appl. No.: 14/503,676

(22) Filed: Oct. 1, 2014

(65) Prior Publication Data

US 2016/0096264 A1 Apr. 7, 2016

(51) Int. Cl.
*B65D 85/28* (2006.01)
*B25H 3/00* (2006.01)
*B25H 3/06* (2006.01)

(52) U.S. Cl.
CPC ..... *B25H 3/003* (2013.01); *B25H 3/06* (2013.01)

(58) Field of Classification Search
CPC ..... B25H 3/003; B25H 3/04; B25H 3/06
USPC ..... 206/372, 373, 374, 375, 376, 377, 378, 206/379, 349; 211/69, 70.6
See application file for complete search history.

(56) References Cited

U.S. PATENT DOCUMENTS 4,826,021 A * 5/1989 Burrell ..... B25H 3/003 211/70.6
5,228,570 A 7/1993 Robinson
5,715,951 A 2/1998 Dembicks
6,386,363 B1 5/2002 Huang
6,488,151 B2 12/2002 Ramsey et al.
7,717,278 B2 * 5/2010 Kao ..... B25H 3/04 206/349
7,931,159 B2 * 4/2011 Kao ..... B25H 3/04 211/70.6
8,733,562 B2 * 5/2014 Kao ..... A47B 81/00 206/378
8,813,957 B1 * 8/2014 Kao ..... B25H 3/003 206/378

(Continued)

FOREIGN PATENT DOCUMENTS

AU 2014203323 A1 12/2015
CN 101407057 B 7/2011

(Continued)

OTHER PUBLICATIONS

English language Abstract of TW I380886 B.

(Continued)

*Primary Examiner* — Jacob K Ackun
*Assistant Examiner* — Jenine Pagan
(74) *Attorney, Agent, or Firm* — Hershkovitz & Associates, PLLC; Abe Hershkovitz

(57) ABSTRACT

A sleeve bracket assembly includes a rail base, a positioning board and multiple positioning mounts. The rail base includes two side boards and a connecting seat connecting with the side boards. Each side board has a sliding rail protruding from an inner surface of the side boards. The connecting seat has a positioning recess formed between the sliding rails and the connecting seat. The positioning board is an elastic elongated strip and mounted in the positioning recess of the rail base. The positioning mounts are rotatably and movably mounted in the rail base and abut the positioning board. The positioning mounts are positioned between the positioning board and the rail base. When no external force is applied, the positioning mounts will not move or rotate.

10 Claims, 12 Drawing Sheets

(56) References Cited

U.S. PATENT DOCUMENTS

| | | | | |
|---|---|---|---|---|
| 2006/0207951 | A1* | 9/2006 | Wang | A47F 5/0006 211/70.6 |
| 2010/0065520 | A1 | 3/2010 | Hsieh | |
| 2011/0089126 | A1 | 4/2011 | Hsieh | |
| 2012/0138553 | A1 | 6/2012 | Kao | |
| 2012/0152871 | A1 | 6/2012 | Kao | |
| 2013/0062480 | A1 | 3/2013 | Kao | |

FOREIGN PATENT DOCUMENTS

| | | | |
|---|---|---|---|
| FR | 2 99 7030 | A1 | 4/2014 |
| GB | 2507040 | A | 4/2014 |
| GB | 2526381 | A | 11/2015 |
| JP | 10-071583 | | 3/1998 |
| JP | 2012-152842 | A | 8/2012 |
| JP | 2014-083634 | A | 5/2014 |
| TW | I283629 | B | 7/2007 |
| TW | I346607 | B | 8/2011 |
| TW | I365802 | B | 6/2012 |
| TW | I380886 | B | 1/2013 |
| TW | I395647 | B | 5/2013 |
| TW | I404658 | B | 8/2013 |
| TW | I409150 | B | 9/2013 |

OTHER PUBLICATIONS

English language Abstract of TW I404658 B.
English language Abstract of TW I395647 B.
English language Abstract of TW I409150 B.
English language Abstract of TW I365802 B.
English language Abstract of TW I346607 B.
English language Abstract of TW I283629 B.
English language Abstract of CN 101407057 B.
English language Abstract of JP 2014-083634 A.
English language Abstract of JP 2012-152842 A.
English language Abstract of JP 10-071583.
English language Abstract of FR 2 99 7030 A1.
Search Report issued by the Taiwan Intellectual Property Office dated Mar. 2, 2015 in related TW 103131726.
Search Report mailed by the Japan Patent Office dated Sep. 20, 2016 in related JP 2014-218362.
Preliminary Search Report issued by the French Patent Office dated May 20, 2015 in related FR 1459335.
Patent Examination Report No. 1 issued by the IP Australia dated Feb. 8, 2016 in related AU 2014240205.
Office Action issued by the Canadian Intellectual Property Office dated Jun. 29, 2016 in related CA 2,865,450.
Search Report under Section 17(5) issued by the UK Intellectual Property Office dated Mar. 10, 2015 in related GB 1417176.3.
Examination Report under Section 18(3) issued by the UK Intellectual Property Office dated Jun. 14, 2016 in related GB 1417176.3.

* cited by examiner

SLEEVE BRACKET ASSEMBLY

BACKGROUND OF THE INVENTION

1. Field of the Invention

The present invention relates to a hand tool assembly, and more particularly to a sleeve bracket assembly.

2. Description of Related Art

A conventional sleeve bracket assembly has a rail base and multiple positioning mounts slidably mounted on the rail base. The positioning mounts are used to hold hex sockets to allow a user to look for the marks of sizes or model numbers on outer peripheries of the hex sockets by rotating. To move or rotate the hex sockets easily and quickly, the rail base is not set up with any fixing structure for fixing the positioning mounts. Hence, the positioning mounts may be moved or rotated by impact or hit by an unexpected force, such that the user has to frequently and repeatedly look for the marks of sizes or model numbers of the hex sockets, which is very inconvenient in use.

To overcome the shortcomings of the conventional rail base and positioning mounts, the present invention provides a sleeve bracket assembly to mitigate or obviate the aforementioned problems.

SUMMARY OF THE INVENTION

In order to reach the said invention objective, the present invention provides a sleeve bracket assembly includes a rail base, a positioning board and multiple positioning mounts. The rail base includes two side boards and a connecting seat connecting with the side boards. Each side board has a sliding rail protruding from an inner surface of the side boards. The connecting seat has a positioning recess formed between the sliding rails and the connecting seat. The positioning board is an elastic elongated strip and mounted in the positioning recess of the rail base. The positioning mounts are rotatably and movably mounted in the rail base and abut the positioning board. The positioning mounts are positioned between the positioning board and the rail base. When no external force is applied, the positioning mounts will not move or rotate.

Other objects, advantages, and novel features of the invention will become more apparent from the following detailed description when taken in conjunction with the accompanying drawing.

DETAILED DESCRIPTION OF PREFERRED EMBODIMENT

Figure 1:
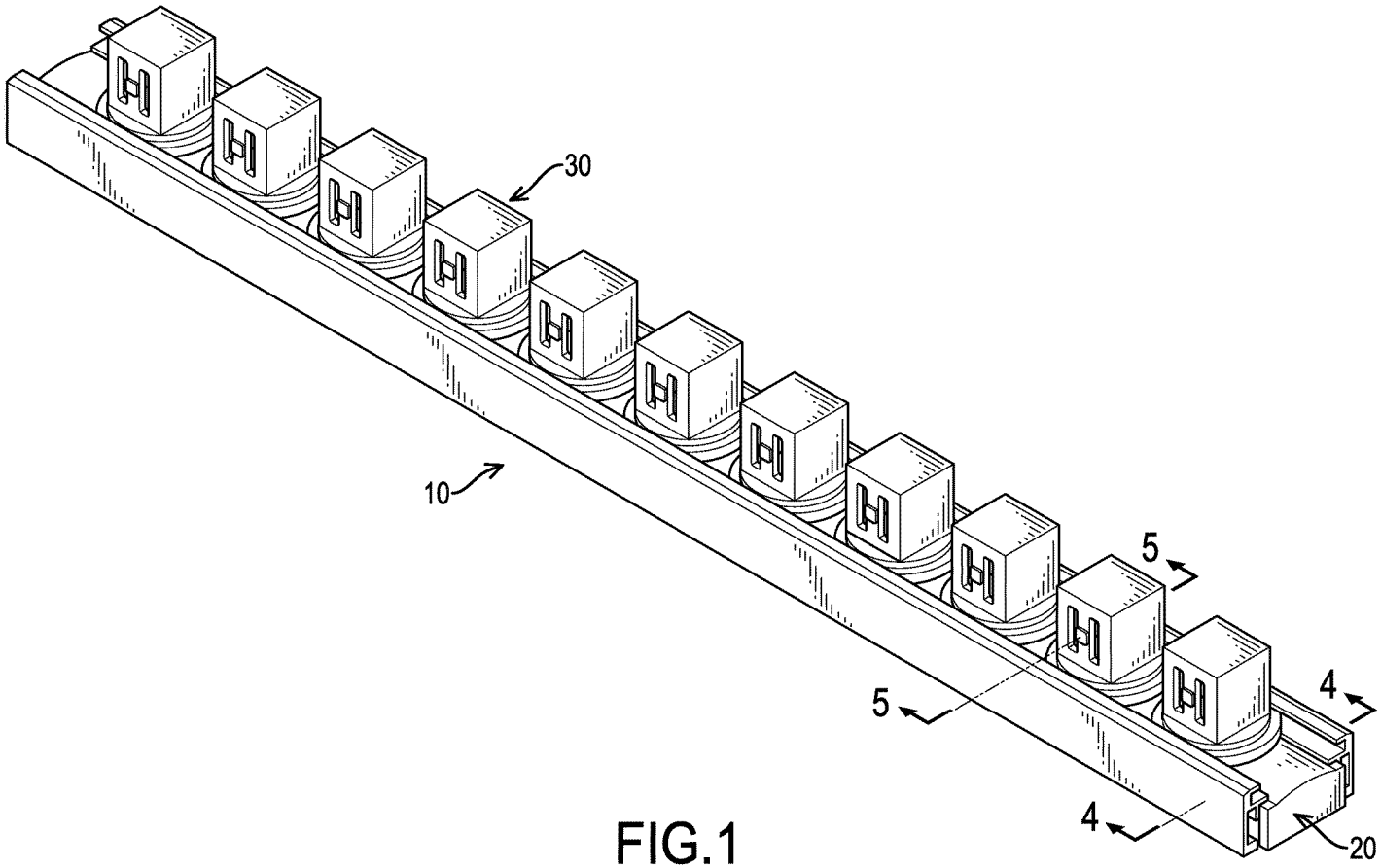
FIG. 1 is a perspective view of a first embodiment of a sleeve bracket assembly in accordance with the present invention.

With reference to FIGS. 1 to 5, a first preferred embodiment of a sleeve bracket assembly includes a rail base 10, a positioning board 20 and multiple positioning mounts 30.

The rail base 10 may be an aluminum extrusion structure and includes two side boards 11 and a connecting seat 12 connecting with the side boards 11. The side boards 11 are disposed vertically at an interval and have two sliding rails 111, a sliding channel 112, an opening 113 and an inserting notch 114. The sliding rails 111 respectively protrude from inner surfaces of the side boards 11 and face to each other. Each sliding rail 111 has an upper abutment surface 1110 and a lower abutment surface 1113 defined respectively at an upper side and a lower side of the sliding rail 111. The sliding channel 112 is formed between inner surfaces of the sliding rails 111 and extends along an axis of the rail base 10. The opening 113 is formed in tops of the side boards 11 of the rail base 10 and communicates with the sliding channel 112. The inserting notch 114 is formed between the sliding rails 111 and communicates with the sliding channel 112 and the opening 113.

The connecting seat 12 is U-shaped in cross-section, is connected with bottoms of the sliding rails 111, and has a positioning recess 121 and a positioning hole 122. The positioning recess 121 is formed between the sliding rails 111 and the connecting seat 12. The positioning hole 122 is formed in the connecting seat 12 at a position adjacent to one end of the connecting seat 12. Preferably, a horizontal width of the opening 113 is smaller than a horizontal width of the positioning recess 121, a horizontal width of inserting notch 114 is smaller than the horizontal width of the positioning recess 121 to prevent the positioning mounts 30 from escaping from the rail base 10.

Figure 2:
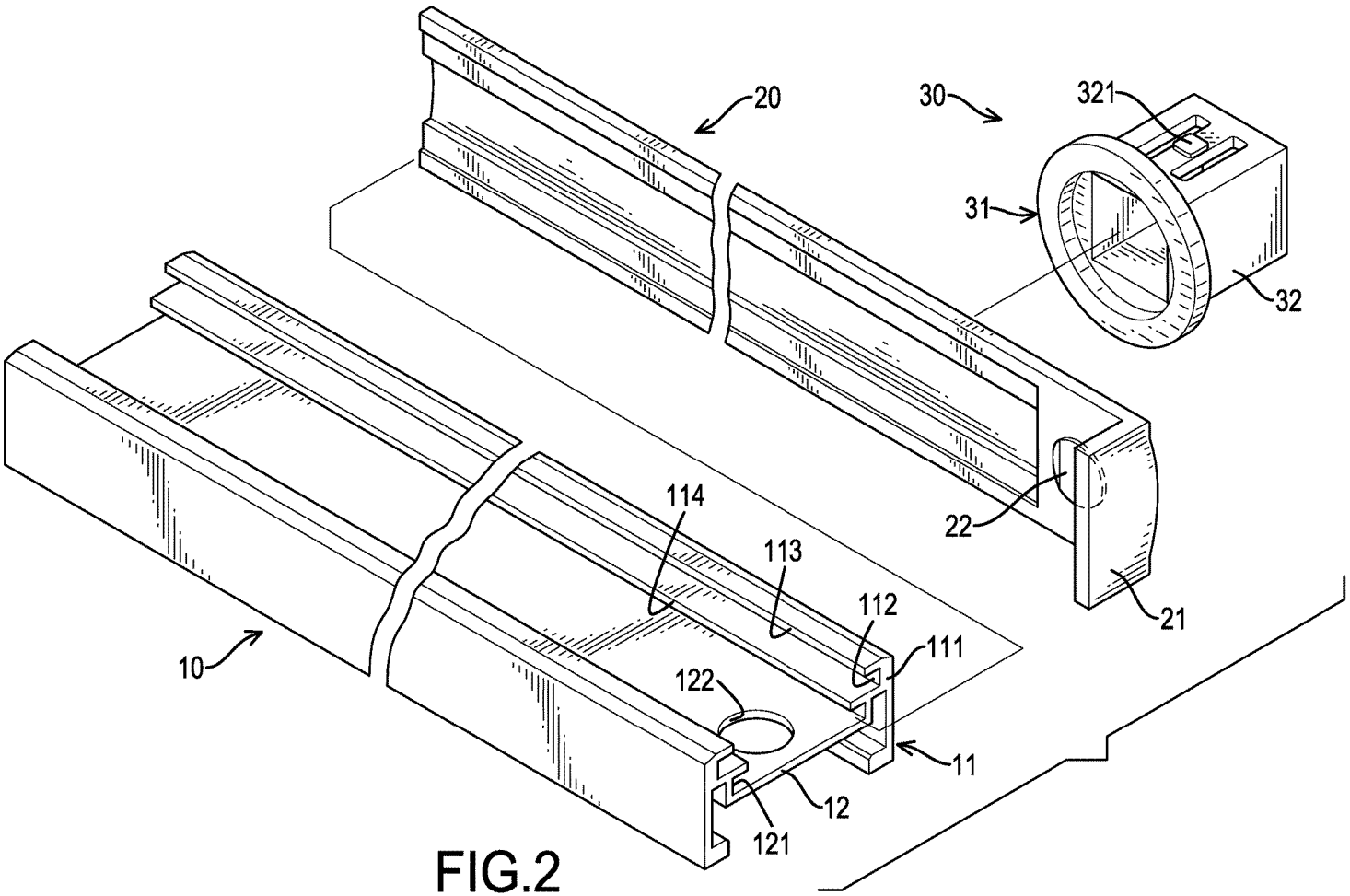
FIG. 2 is an enlarged exploded perspective view of the first embodiment of the sleeve bracket assembly in FIG. 1.
Figure 3:
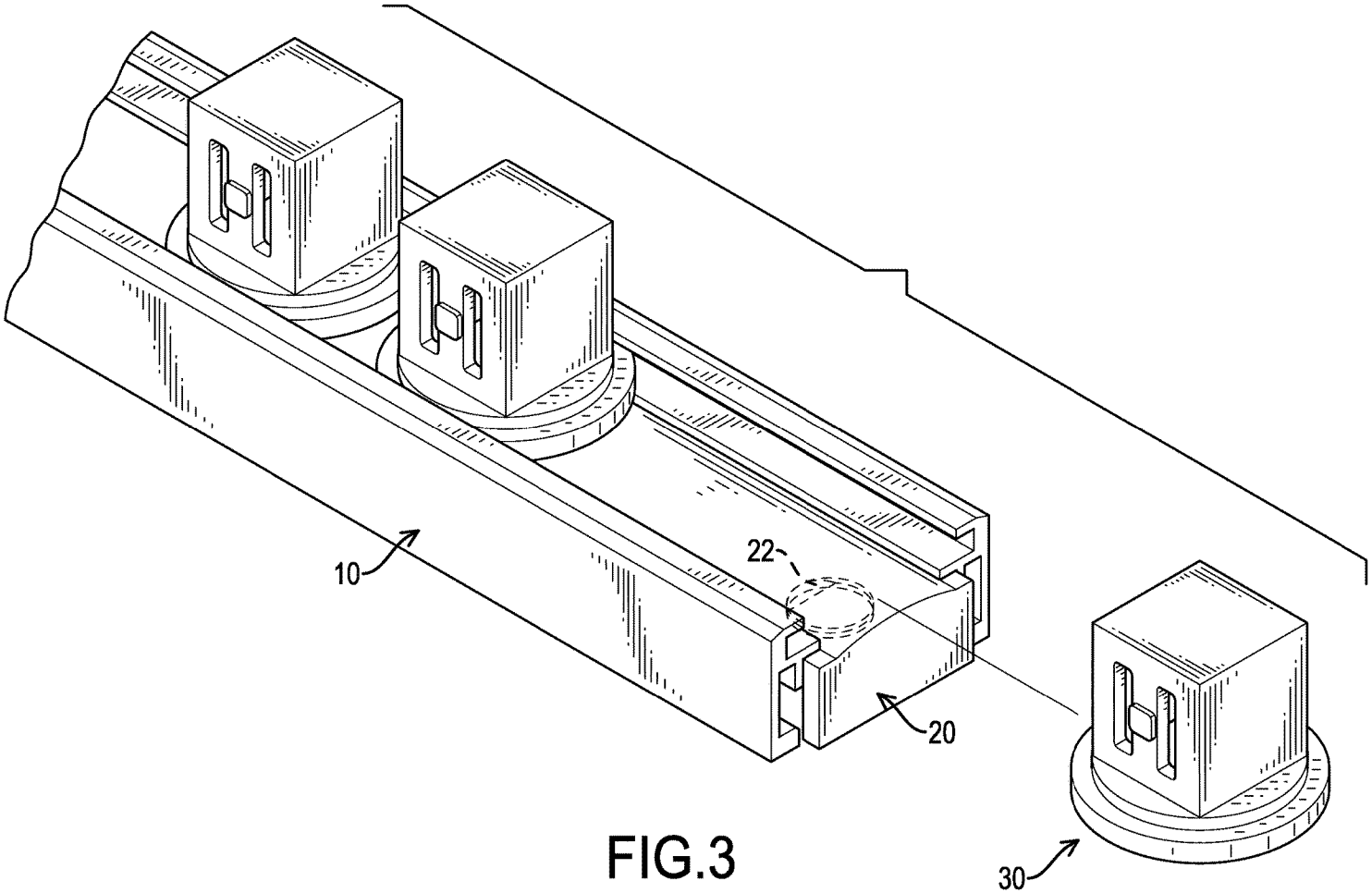
FIG. 3 is another enlarged exploded perspective view of the first embodiment of the sleeve bracket assembly in FIG. 1.
Figure 4:
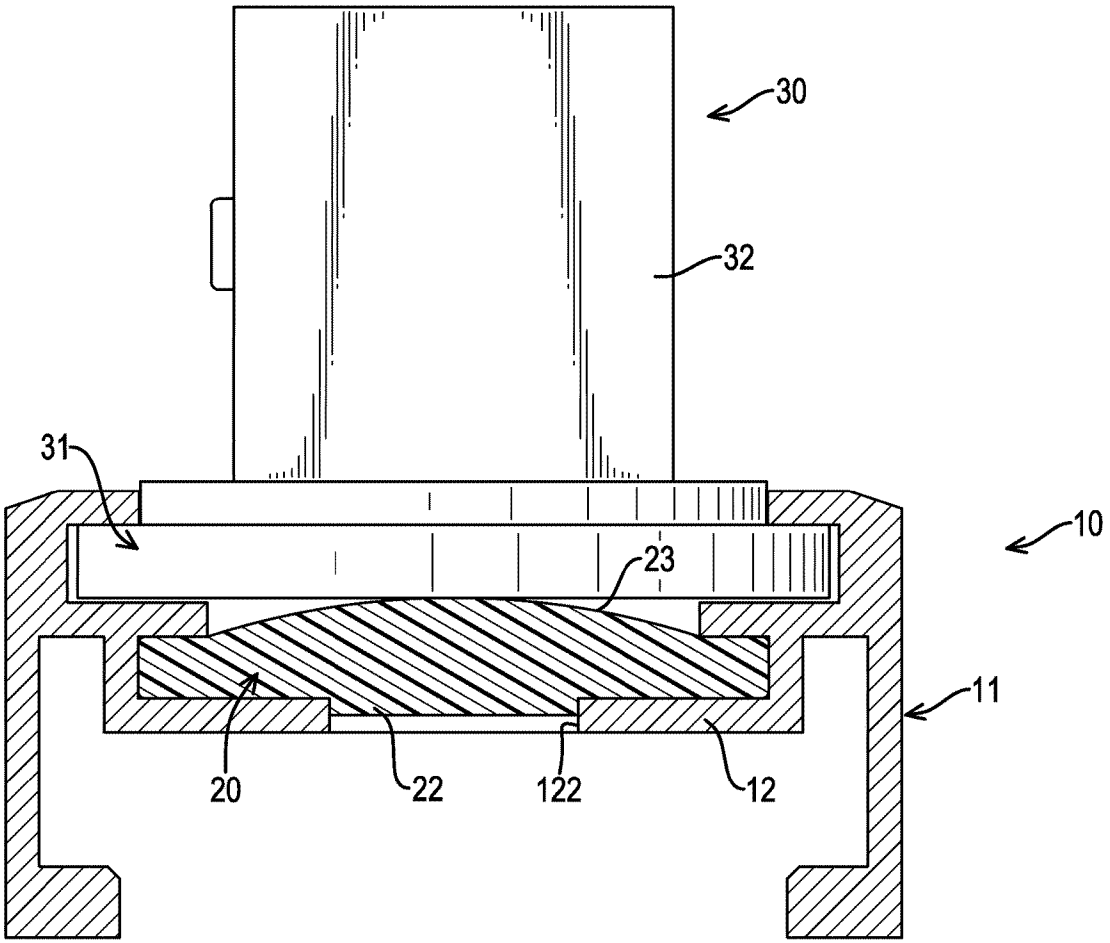
FIG. 4 is an enlarged side view in partial section of the first embodiment of the sleeve bracket assembly along line 4-4 in FIG. 1.

With reference to FIGS. 2 to 4, the positioning board 20 is an elastic elongated strip and extends along the axis of the rail base 10; preferably, the positioning board 20 is made of plastic steel material. The positioning board 20 is mounted in the positioning recess 121 of the rail base 10 and has a blocking wall 21, a positioning protrusion 22 and an abutment portion 23. The blocking wall 21 protrudes downwardly from one end of the positioning board 20. The positioning protrusion 22 is formed on a bottom of the positioning board 20, is located adjacent to the blocking wall 21 and corresponds to the positioning hole 122 in shape. When the positioning board 20 is mounted in the rail base 10, the positioning protrusion 22 is engaged in the positioning hole 122, and the blocking wall 21 abuts one end of the rail base 10 to firmly connect the positioning board 20 with the rail base 10.

The abutment portion 23 protrudes upwardly from a central portion of the positioning board 20, protrudes into the sliding channel 112 via the inserting notch 114, extends longitudinally along the positioning board 20, and is shaped as a bulge protruding on a central portion of the abutment portion 23 and gradually inclined toward two sides of the bulge. Preferably, an uppermost point of the abutment portion 23 is located above the lower abutment surfaces 1113 of the sliding rails 111.

Figure 5:
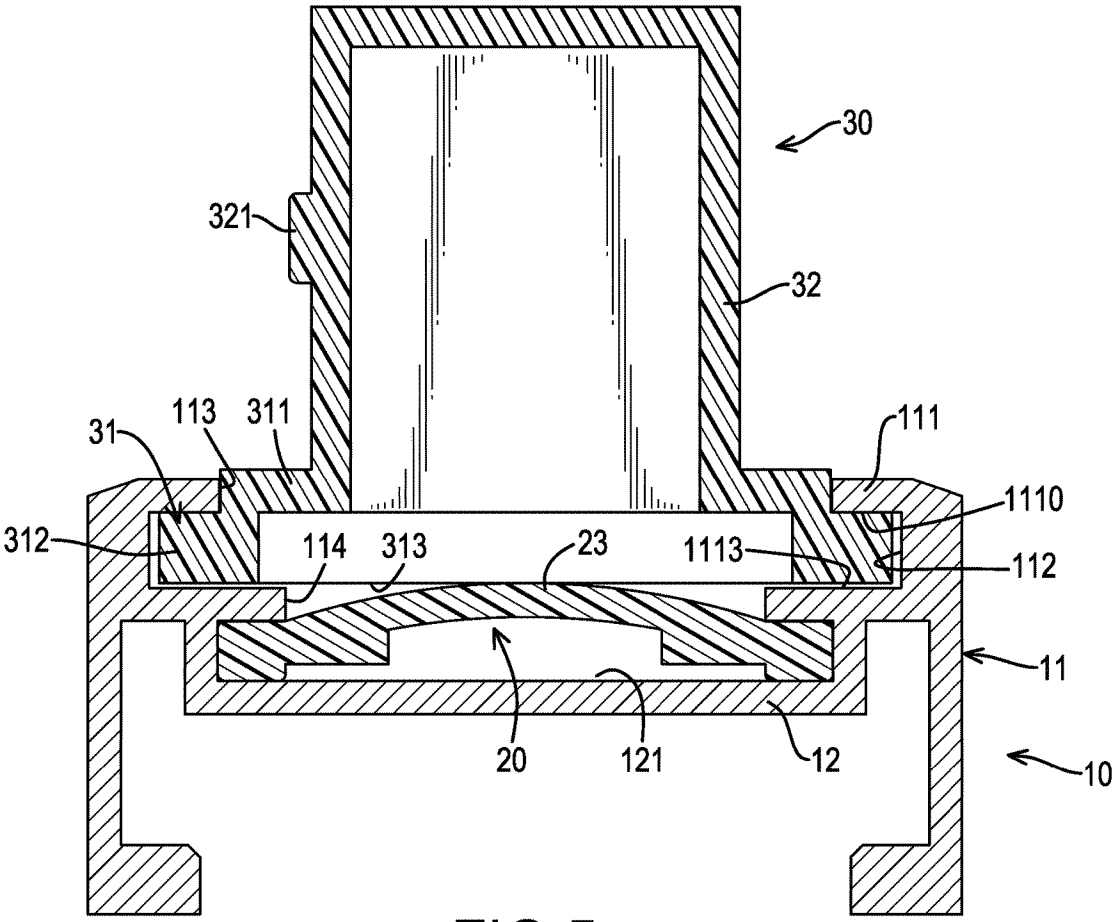
FIG. 5 is an enlarged side view in partial section of the first embodiment of the sleeve bracket assembly along line 5-5 in FIG. 1.

With reference to FIGS. 2, 3 and 5, the positioning mounts 30 are movably mounted in the sliding channel 112 of the rail base 10, and are rotatable relative to the abutment portion 23. Each positioning mount 30 includes a sliding portion 31 and a socket portion 32 and is slidably engaged in the sliding channel 112 by the sliding portion 31. The sliding portion 31 can be a round or stepped plate; preferably, the sliding portion 31 is a double-stepped round plate, which is divided as an upper step 311 and a lower step 312. A diameter of the lower step 312 is larger than a diameter of the upper step 311. The diameter of the lower step 312 is smaller than a horizontal width of sliding channel 112. The diameter of the upper step 311 is smaller than the horizontal width of the opening 113. An abutment surface 313 is formed on a bottom of the sliding portion 31 and is flat and annular. The socket portion 32 is rectangular in cross-section and is integratedly formed on a top surface of the upper step 311 and has a positioning protrusion 321 formed on a side surface of the socket portion 32 at a radial direction of the socket portion 32 for mounting a hex socket or other hand tools.

Figure 6:
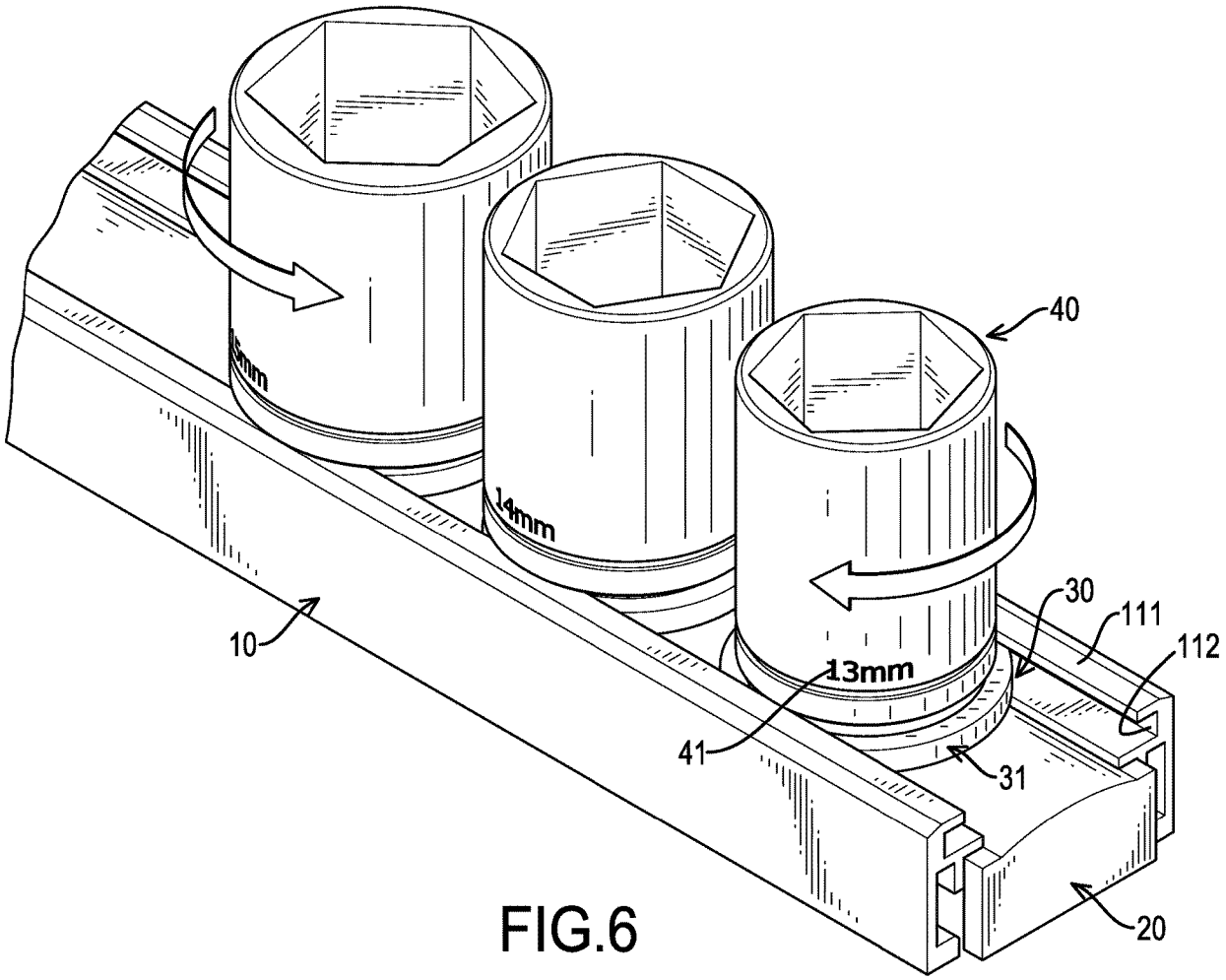
FIG. 6 is an enlarged operational perspective view of the first embodiment of the sleeve bracket assembly in FIG. 1.
Figure 7:
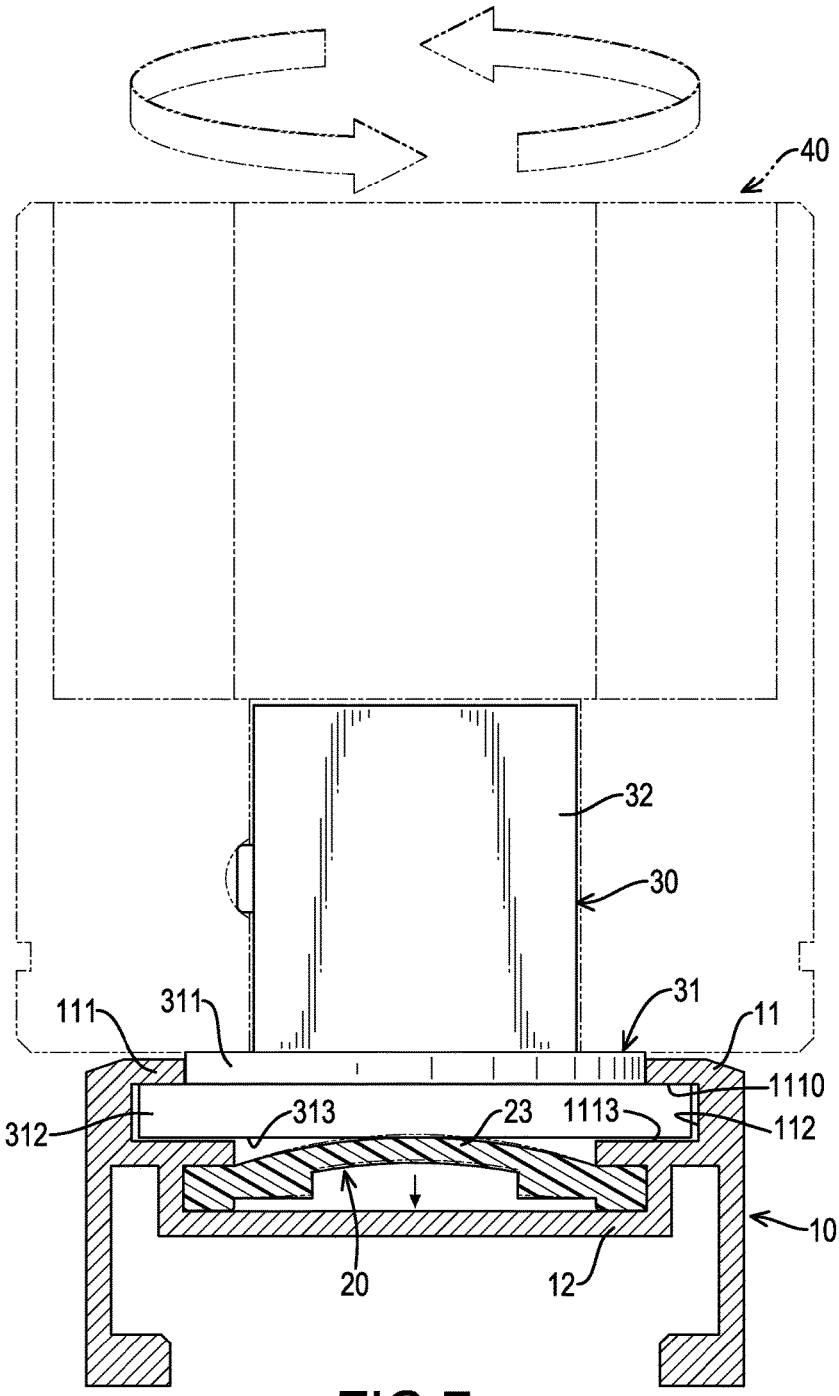
FIG. 7 is an operational side view in partial section of the first embodiment of the sleeve bracket assembly in FIG. 6.

With reference to FIGS. 6 and 7, multiple hex sockets 40 are respectively mounted on the positioning mounts 30, and each hex socket 40 has an indication sign 41 mounted in an outer periphery of the socket 40 to allow a user to rotate the positioning mounts 30 for recognizing the size or model number of the socket 40. The positioning mounts 30 are mounted in the sliding channel 112 by the sliding portion 31, the abutment surface 313 of each positioning mount 30 abuts the abutment portion 23 of the positioning board 20, and a top surface of the lower step 312 of each positioning mount 30 abuts the upper abutment surfaces 1110 of the sliding rails 111. Hence, the positioning mounts 30 are positioned on the positioning board 20 and the rail base 10 to maintain three-point contact. When the user wants to rotate or move the hex sockets 40, the positioning mounts 30 must be pressed or be applied with a vertical or horizontal force to make the positioning mounts 30 slightly separated from the sliding rails 111. Otherwise, the positioning mounts 30 are fixed between the positioning board 20 and the rail base 10 and will not move or rotate except when being applied with external forces.

Therefore, the user can easily and quickly find the indication signs 41 of the hex sockets 40 without moving or rotating the sockets 40 repeatedly to save a lot of time for finding a correct socket 40. Furthermore, when the positioning board 20 is broken or has an elasticity failure, the user can replace the positioning board 20 with a new one by pulling out the positioning board 20 from the rail base 10.

Figure 8:
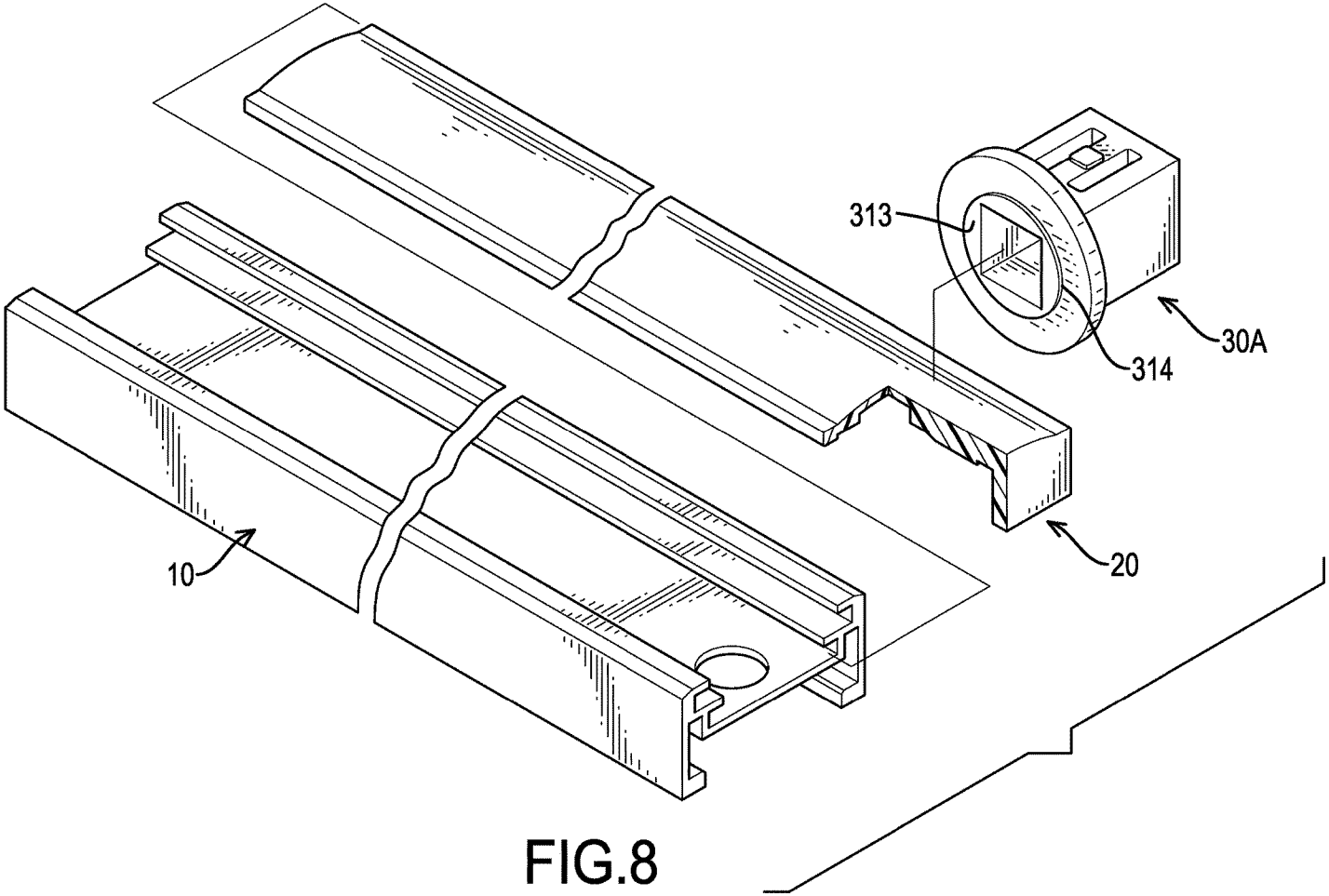
FIG. 8 is an exploded perspective view of a second embodiment of a sleeve bracket assembly in accordance with the present invention.
Figure 9:
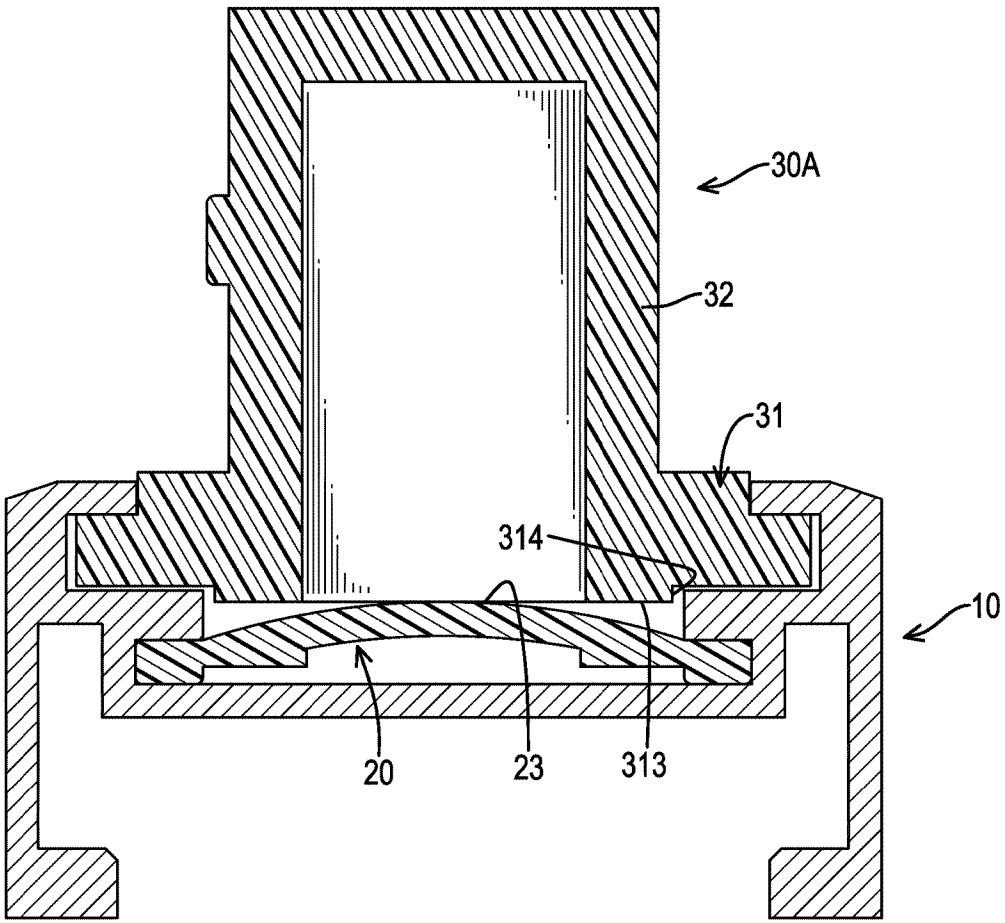
FIG. 9 is a cross-sectional side view of the second embodiment of the sleeve bracket assembly in FIG. 8.

With reference to FIGS. 8 and 9, in a second preferred embodiment of the sleeve bracket assembly in accordance with the present invention, the elements and effects of the second embodiment are same as those of the first embodiment except the shape of the positioning mounts 30A.

With reference to FIGS. 8 and 9, each positioning mount 30A has a protrusion 314 formed on the bottom of the sliding portion 31A, and the abutment surface 313 is defined on a bottom surface of the protrusion 314. The abutment surface 313 of each positioning mount 30A abuts the abutment portion 23 of the positioning board 20.

Figure 10:
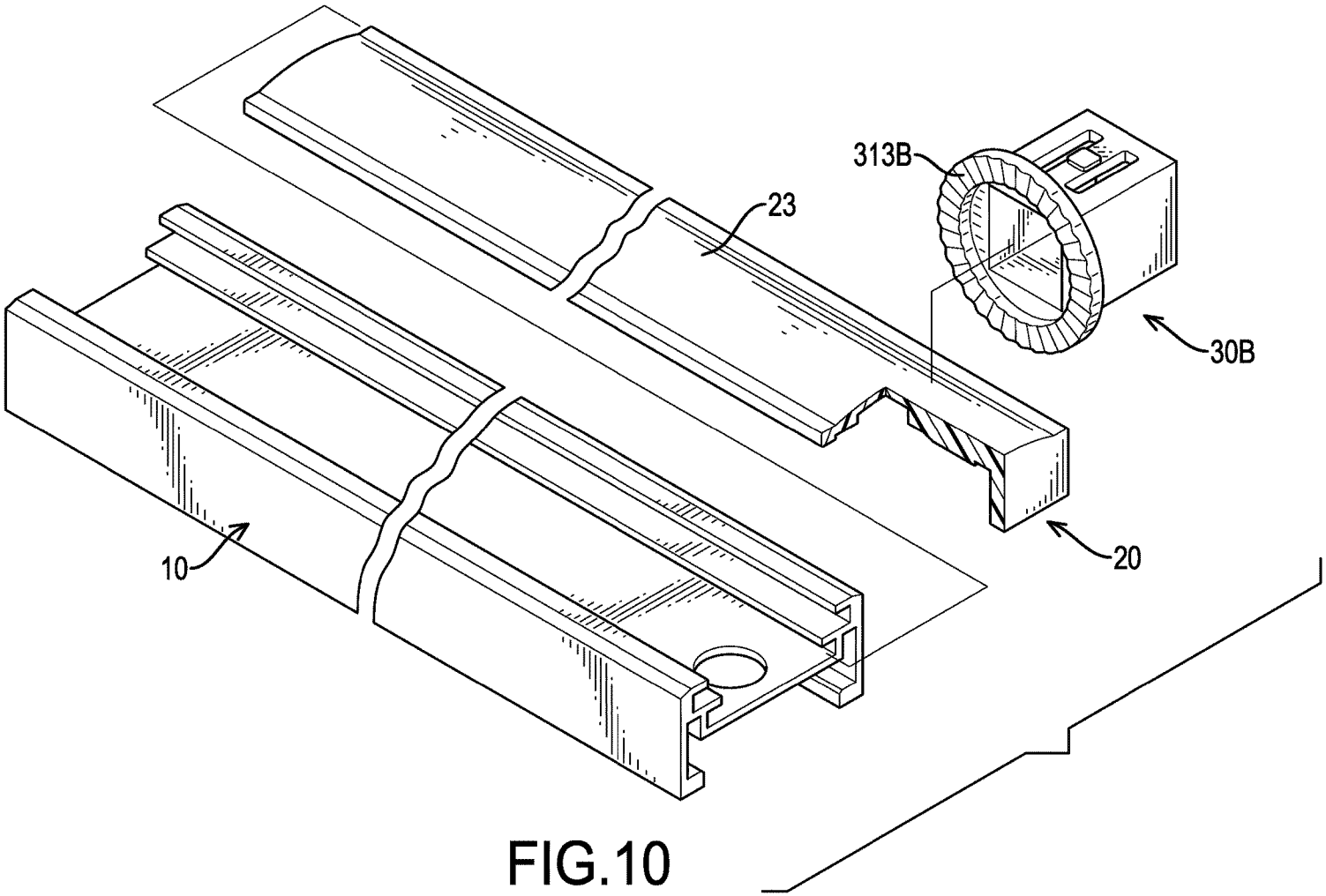
FIG. 10 is an exploded perspective view of a third embodiment of a sleeve bracket assembly in accordance with the present invention.

With reference to FIG. 10, in a third preferred embodiment of the sleeve bracket assembly in accordance with the present invention, the elements and effects of the third embodiment are same as those of the first embodiment except the shape of the positioning mounts 30B, the abutment surface 313B of the positioning mount 30B is wave-shaped, forming gentle arcs with concave and convex portions to increase frictions and to improve the positioning effects between the abutment surface 313B and the positioning board 20.

Figure 11:
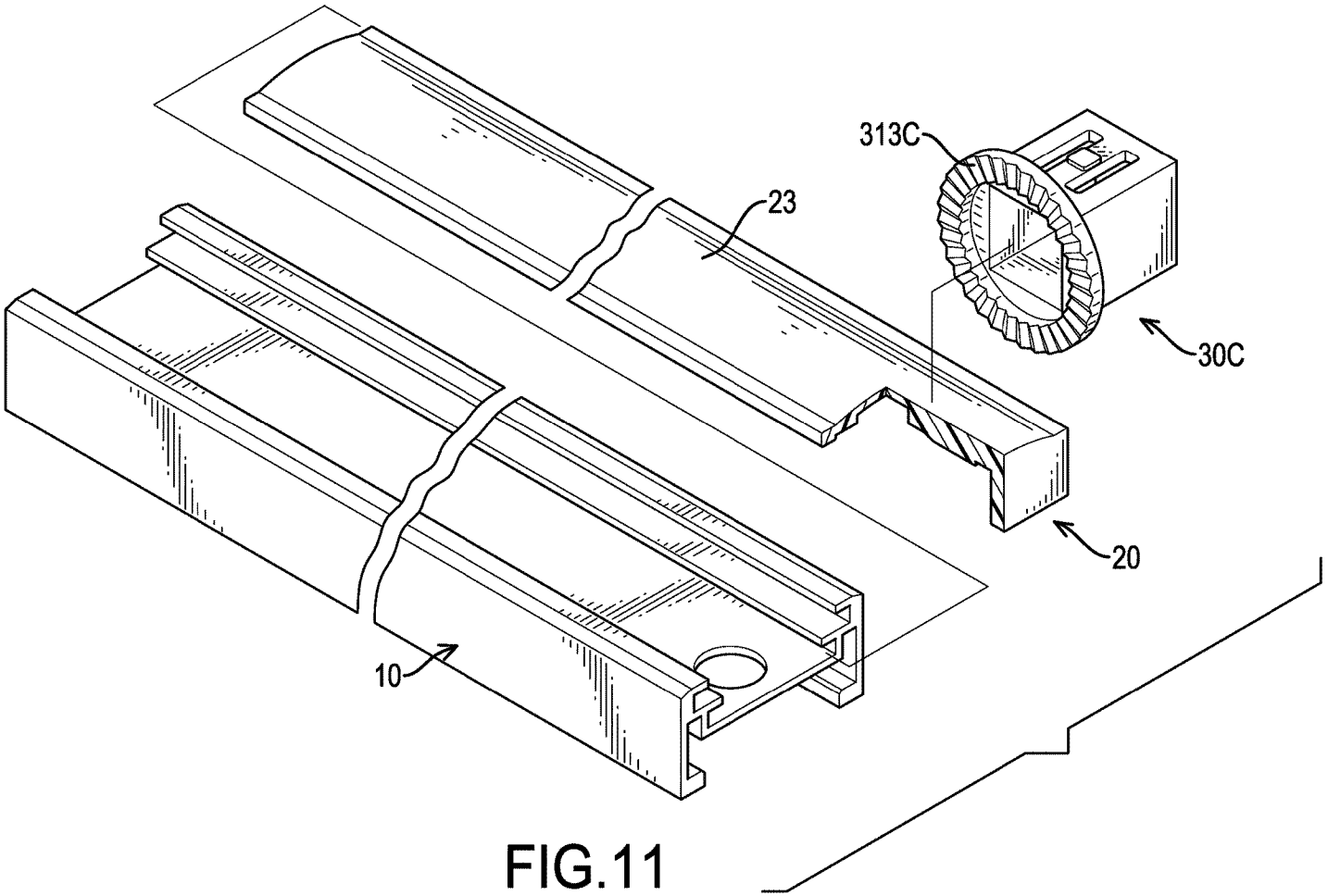
FIG. 11 is an exploded perspective view of a fourth embodiment of a sleeve bracket assembly in accordance with the present invention.

With reference to FIG. 11, in a fourth preferred embodiment of the sleeve bracket assembly in accordance with the present invention, the elements and effects of the fourth embodiment are same as those of the first embodiment except the shape of the positioning mounts 30C. The abutment surface 313C of the positioning mount 30C is sharply toothed, formed with concave and convex portions to increase frictions and to improve the positioning effects between the abutment surface 313C and the positioning board 20.

Figure 12:
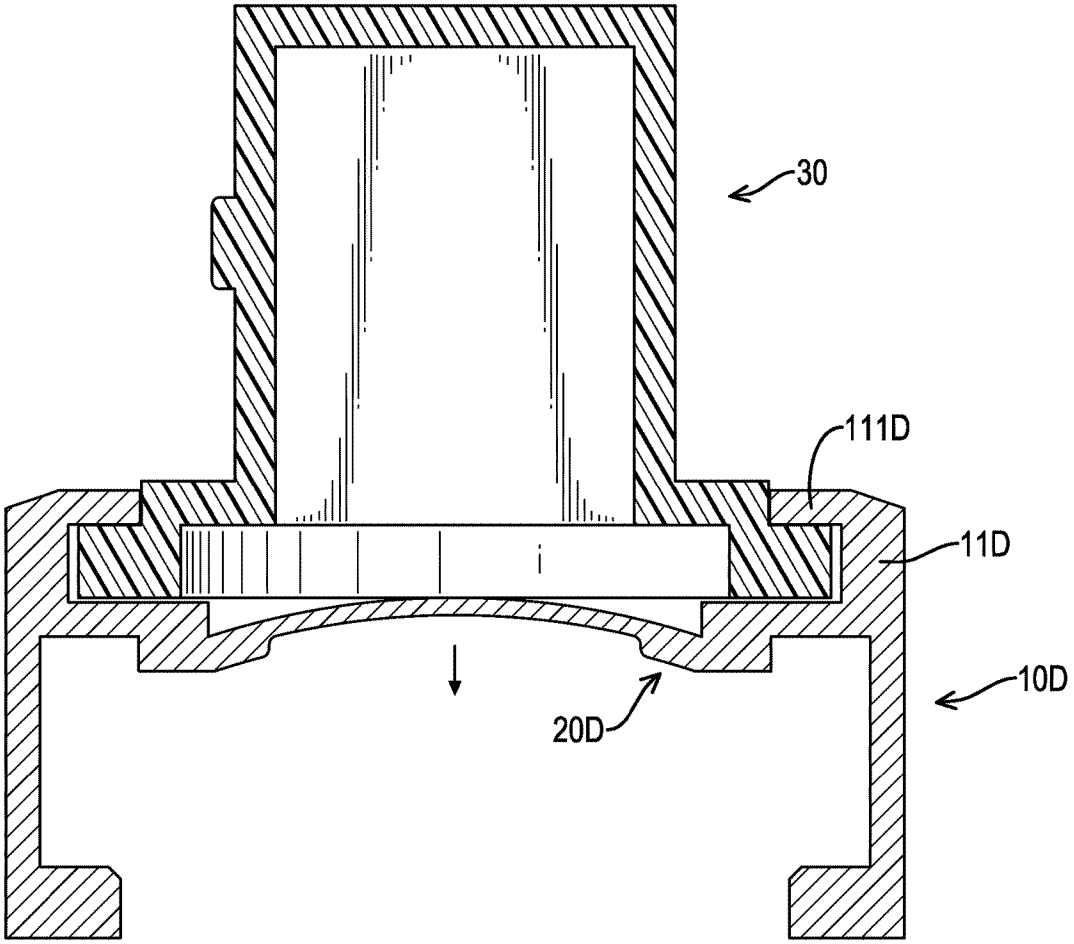
FIG. 12 is a cross-sectional side view of a fifth embodiment of a sleeve bracket assembly in accordance with the present invention.

With reference to FIG. 12, in a fifth preferred embodiment of the sleeve bracket assembly in accordance with the present invention, the elements and effects of the fifth embodiment are same as those of the first embodiment except the positioning board 20D and the rail base 10D are integratedly formed as a single part. The rail base 10D has two side boards 11D disposed vertically at an interval and having two sliding rails 111D respectively protruding from inner surfaces of the side boards 11D. The positioning board 20D is an elastic strip and is integratedly connected with the bottoms of the sliding rails 111. Therefore, the rail base 10D and the positioning board 20D are formed integratedly as a single part to save material and to reduce cost in manufacture, and a space for a connecting seat is unnecessary.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sleeve bracket assembly comprising:

a rail base including two side boards disposed vertically at an interval and having two sliding rails respectively protruding from inner surfaces of the side boards and facing each other;

a sliding channel formed between inner surfaces of the sliding rails;

an inserting notch formed between the sliding rails and communicating with the sliding channel;

a connecting seat connected with bottoms of the sliding rails and having a positioning recess formed between the sliding rails and the connecting seat;

a positioning board being an elastic elongated strip, mounted in the positioning recess of the rail base, and having an abutment portion having a curved cross section and protruding upwardly from a central portion of the positioning board and protruding into the sliding channel via the inserting notch;

multiple positioning mounts movably mounted in the sliding channel of the rail base, and being rotatable relative to the abutment portion and each positioning mount including a sliding portion having an abutment surface formed on a bottom of the sliding portion; and a socket portion integratedly formed on a top surface of the sliding portion, wherein the positioning mounts are mounted in the sliding channel by the sliding portion, the abutment surfaces of the positioning mounts abut the abutment portion of the positioning board, and the sliding portions abut inner sides of the sliding rails.

2. The sleeve bracket assembly as claimed in claim 1, wherein each sliding rail has a lower abutment surface defined at a lower side inside the sliding rail, the abutment portion is shaped as a bulge protruding in a central portion of the abutment portion and gradually inclined toward two sides of the bulge, and an uppermost point of the abutment portion is located above the lower abutment surface of the sliding rail.

3. The sleeve bracket assembly as claimed in claim 2, wherein the positioning board has a blocking wall protruding downwardly from one end of the positioning board and abutting one end of the rail base.

4. The sleeve bracket assembly as claimed in claim 3, wherein the connecting seat has a positioning hole formed adjacent one end of the connecting seat, the positioning board has a positioning protrusion formed on a bottom of the positioning board, located adjacent to the blocking wall and corresponding to the positioning hole in shape, and the positioning protrusion is engaged in the positioning hole.

5. The sleeve bracket assembly as claimed in claim 4, wherein each positioning mount has a protrusion formed on the bottom of the sliding portion, and the abutment surface of each positioning mount is defined on a bottom surface of the protrusion of the positioning mount.

6. The sleeve bracket assembly as claimed in claim 1, wherein the shape of the abutment surface of the positioning mount is flat, wave-shaped, or toothed.

7. The sleeve bracket assembly as claimed in claim 2, wherein the shape of the abutment surface of the positioning mount is one of, flat, wave-shaped, or toothed.

8. The sleeve bracket assembly as claimed in claim 3, wherein the shape of the abutment surface of the positioning mount is one of, flat, wave-shaped, or toothed.

9. The sleeve bracket assembly as claimed in claim 4, wherein the shape of the abutment surface of the positioning mount is one of, flat, wave-shaped, or toothed.

10. The sleeve bracket assembly as claimed in claim 5, wherein the shape of the abutment surface of the positioning mount is one of, flat, wave-shaped, or toothed.

* * * * *